US006127329A

United States Patent [19]

Baillely et al.

[11] Patent Number: 6,127,329

[45] Date of Patent: Oct. 3, 2000

[54] DETERGENT COMPOSITIONS

[75] Inventors: Gerard Marcel Baillely; Robin Gibson Hall, both of Newcastle upon Tyne; Barry Thomas Ingram, Whitley Bay; Michael Alan John Moss, Stocksfield, all of United Kingdom

[73] Assignee: The Procter & Gamble Company, Cincinnati, Ohio

[21] Appl. No.: 09/290,939

[22] Filed: Apr. 13, 1999

Related U.S. Application Data

[63] Continuation of application No. PCT/US97/17814, Oct. 2, 1992.

[51] Int. Cl.[7] ..... C11D 3/386; C11D 1/62; C11D 1/12

[52] U.S. Cl. ..... 510/320; 510/299; 510/300; 510/321; 510/340; 510/341; 510/350; 510/392; 510/530

[58] Field of Search ..... 510/299, 300, 510/320, 321, 340, 341, 350, 504, 530, 392; 8/137

[56] References Cited

U.S. PATENT DOCUMENTS

| | | | |
|---|---|---|---|
| 4,102,825 | 7/1978 | Murata | 252/547 |
| 4,264,466 | 4/1981 | Carleton et al. | 252/99 |
| 4,302,364 | 11/1981 | Gosset et al. | 252/8.75 |
| 4,594,184 | 6/1986 | Cook et al. | 252/542 |
| 4,622,173 | 11/1986 | Broze et al. | 252/528 |
| 4,713,194 | 12/1987 | Gosselink | 252/174.23 |
| 4,931,216 | 6/1990 | Igarashi et al. | 252/547 |
| 5,037,992 | 8/1991 | Ward et al. | 558/36 |
| 5,073,274 | 12/1991 | Caswell | 252/8.6 |
| 5,433,882 | 7/1995 | Matsumoto | 252/160 |
| 5,466,394 | 11/1995 | De Buzzaccarini et al. | 252/547 |
| 5,622,925 | 4/1997 | de Buzzaccarini et al. | 510/329 |

FOREIGN PATENT DOCUMENTS

| | | | |
|---|---|---|---|
| 0002084 | 5/1979 | European Pat. Off. | C11D 1/00 |
| 0635566 | 1/1995 | European Pat. Off. . | |
| WO 98/17766 | 4/1998 | WIPO | C11D 3/386 |
| WO 98/17767 | 4/1998 | WIPO | C11D 3/386 |
| WO 98/17768 | 4/1998 | WIPO | C11D 3/386 |
| WO 98/17769 | 4/1998 | WIPO | C11D 3/386 |

*Primary Examiner*—Kery Fries
*Attorney, Agent, or Firm*—Ian S. Robinson; Kim William Zerby; Jacobus C. Rasser

[57] ABSTRACT

The present invention relates to detergent compositions or components thereof containing a detersive enzyme and one or more cationic surfactants of the formula:

$$R^1R^2R^3R^4N^+X^-$$

in which $R^1$ is a hydroxyalkyl group having no greater than 6 carbon atoms; each of $R^2$ and $R^3$ is independently selected from $C_{1-4}$ alkyl or alkenyl; $R^4$ is a $C_{5-11}$ alkyl or alkenyl; and $X^-$ is a counterion.

10 Claims, No Drawings

DETERGENT COMPOSITIONS

DETERGENT COMPOSITIONS

This is a continuation of PCT International Application Serial No. PCT/US97/17814, filed Oct. 2, 1997; which claims priority to GB Application Serial No. 9621799.7, filed Oct. 18, 1996; GB 9621791.4, filed Oct. 18, 1996; and GB 9705826.7, filed Mar. 20, 1997. PCT/US97/17854, filed Oct. 2, 1997; GB 9705798.8, filed Mar. 20, 1997; PCT/US97/17815, filed Oct. 2, 1997; GB 9705817.6, filed Mar. 20, 1997; PCT/US97/17816, filed Oct. 2, 1997; and GB 9705736.8, filed Mar. 20, 1997.

TECHNICAL FIELD

The present invention relates to detergent compositions or components thereof containing cationic surfactant and a detersive enzyme for use in laundry and dish washing processes to provide enhanced greasy stain removal and cleaning benefits.

BACKGROUND TO THE INVENTION

It is known to use cationic surfactants in detergent compositions. For example, GB 2040990A describes granular detergent compositions comprising cationic surfactants.

Other detergent components often employed in detergent compositions are detersive enzymes which are known to assist in breakdown and removal of stains.

The Applicant has found that in some cases, particularly from some body soils, for example on collar and cuff stains, oily, greasy soils may contain proteinaceous soils which are difficult to break down because the greasy, oily soil component protects the proteinaceous component of the stain.

The Applicant has found that using a specific class of cationic surfactant in combination with a detersive enzyme, the greasy component of the stain is removed, exposing the previously protected stain and making it available for enzyme action. The combination provides improved cleaning benefits coupled with enhanced residual stain removal, the continued use of a detergent formulation according to the invention maintains good stain removal benefits prolonging the new look of washed garments.

Furthermore, generally, the stain removal performance of detersive enzymes is directly related to their concentration in the detergent composition, so that an increase in the amount of detersive enzyme increases the stain removal performance. It has however been observed that under stressed conditions, such as the use of short washing machine cycles, or at low temperatures or in the presence of highly stained substrates, the optimum performance of the detersive enzyme is limited beyond a certain level. Increasing the level of detersive enzyme beyond this amount does not result in increased stain removal performance benefits.

The Applicant has now found that these problems can be ameliorated by a detergent composition comprising a combination of a specific quaternary ammonium cationic surfactant and a detersive enzyme. The invention has been found to be particularly beneficial in detergent compositions which additionally comprise anionic surfactants.

Without wishing to be bound by theory, the Applicant believes that the particular cationic surfactants used in the detergent compositions of the present invention have surprisingly good solubility and form an association in the presence of anionic components to produce surprisingly soluble anionic/cationic complexes which lead to unexpected performance benefits. Furthermore, it is believed that following breakdown of the oily soil by the enzyme, the cationic surfactants used in the present invention may also form complexes with the fatty acids and any other negatively charged breakdown product produced, increasing their solubility and enhancing greasy, oily soil removal and overall cleaning performance.

All documents cited in the present description are incorporated herein by reference.

SUMMARY OF THE INVENTION

The present invention relates to a detergent composition or component thereof which comprises (a) a detersive enzyme; and (b) a cationic surfactant of formula I:

$$R^1R^2R^3R^4N^+X^- \quad (I)$$

in which $R^1$ is a hydroxyalkyl group having no greater than 6 carbon atoms; each of $R^2$ and $R^3$ is independently selected from $C_{1-4}$ alkyl or alkenyl; $R^4$ is a $C_{5-11}$ alkyl or alkenyl; and $X^-$ is a counterion.

Unless otherwise stated alkyl or alkenyl as used herein may be branched, linear or substituted. Substituents may be for example, aromatic groups, heterocyclic groups containing one or more N, S or O atoms, or halo substituents.

DETAILED DESCRIPTION OF THE INVENTION

Cationic Surfactant

The cationic surfactant is generally present in the composition or component thereof in an amount no greater than 60% by weight, preferably no greater than 10% by weight, most preferably in an amount no greater than 4.5% or even 3% by weight. The benefits of the invention are found even with very small amounts of the cationic surfactant of formula I. Generally there will be at least 0.01% by weight, preferably at least 0.05% or at least 0.1% by weight of the cationic surfactant in the detergent compositions of the invention.

Preferably $R^1$ in formula I is a hydroxyalkyl group, having no greater than 6 carbon atoms and preferably the —OH group is separated from the quaternary ammonium nitrogen atom by no more than 3 carbon atoms. Preferred $R^1$ groups are $—CH_2CH_2OH$, $—CH_2CH_2CH_2OH$, $—CH_2CH(CH_3)OH$ and $—CH(CH_3)CH_2OH$. $—CH_2CH_2OH$ and $—CH_2CH_2CH_2OH$ are more preferred and $—CH_2CH_2OH$ is particularly preferred. Preferably $R^2$ and $R^3$ arc each selected from ethyl and methyl groups and most preferably both $R^2$ and $R^3$ are methyl groups. Preferred $R^4$ groups have at least 6 or even at least 7 carbon atoms. $R^4$ may have no greater than 9 carbon atoms, or even no greater than 8 or 7 carbon atoms Preferred $R^4$ groups are linear alkyl groups. Linear $R^4$ groups having from 8 to 11 carbon atoms, or from 8 to 10 carbon atoms are preferred. Preferably each of $R^2$ and $R^3$ is selected from $C_{1-4}$ alkyl and $R^4$ is $C_{6-11}$ alkyl or alkenyl.

Whilst pure or substantially pure cationic compounds are within the ambit of this invention, it has been found that mixtures of the cationic surfactants of formula I may be particularly effective. Mixtures of cationic surfactants of the present invention may comprise mixtures of formula I, preferably where there is at least 10%, or even at least 20%, or at least 50% by weight cationic surfactant of formula I and wherein $R^4$ is $C_{5-9}$ alkyl or alkenyl. Other useful examples of surfactant s mixtures include those in which $R^4$ may be a combination of $C_8$ and $C_{10}$ linear alkyl groups, or $C_9$ and $C_{11}$ alkyl groups. According to one aspect of the invention a mixture of cationic surfactants of formula I is present in the composition, the mixture comprising a shorter alkyl chain surfactant of formula I and a longer alkyl chain surfactant of formula I. Preferably in the mixture of shorter and longer alkyl chain surfactants, there will be from 5 to 95% by weight shorter alkyl chain surfactant or at least 30% by weight shorter alkyl chain surfactant and preferably from 40 to 95% of the shorter alkyl chain cationic. Generally the amount of longer chain cationic surfactant will be from 5 to 95% by weight preferably from 5 to 70% by weight, more preferably from 35 to 75% by weight of the cationic surfactant, preferably at least 50% by weight longer alkyl chain surfactant. The longer alkyl chain cationic surfactant is selected from the surfactants of formula I where $R^4$ is an alkyl group having n carbon atoms where n is from 8 to 11; the shorter alkyl chain surfactant is preferably selected from those of formula I where $R^4$ is an alkyl group having (n−2) carbon atoms.

X in formula I may be any counterion providing electrical neutrality, but is preferably selected from the group consisting of halide, methyl sulfate, sulfate and nitrate, more preferably being selected from methyl sulfate, chloride, bromide and iodide. The halide ions, especially chloride are most preferred.

Detersive Enzyme

The granular detergent compositions or component thereof in accordance with the present invention also comprises a detersive enzyme.

The weight ratio of detersive enzyme to cationic surfactant is generally from 1:15000 to 10:1, more preferably from 1:10000 to 5:1, most preferably from 1:5000 to 1:1, based on % by weight active enzyme of the detergent composition.

In the detergent compositions of the present invention, the detersive enzyme component is generally present at levels of from 0.00005% to 2% of active enzyme by weight of the detergent composition, preferably 0.0001% to 0.2% by weight, most preferably from 0.0002% to 0.05% by weight active enzyme in the detergent composition.

The detersive enzyme can be selected from protease, amylase, cellulase, lipase and mixtures thereof.

Examples of suitable protease enzymes for use in the detergent compositions of the present invention are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL®, PROPERASE® and MAXAPEM® (protein engineered Maxacal) from Gist-Brocades. Detersive enzymes also encompass modified bacterial scrine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is what is called herein "Protease C", which is a variant of an alkaline serine protease from Bacillus in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefacienis* subtilisin, as described in WO95/10591 and in the patent application of C. Ghosh, et al, "Bleaching Compositions Comprising Protease Enzymes" having U.S. Ser. No. 08/322,677, filed Oct. 13, 1994.

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

The protease enzyme or mixture of protease enzymes may be added to the detergent composition as a separate ingredient (eg. in the form of a prill, granulate, stabilized liquid, etc.) or as a mixture with two or more protease enzymes or protease and an additional enzyme, for example as part of a co-granulate.

The detergent compositions of the invention may also contain one or a mixture of more than one amylase enzyme (α and/or β). WO94/02597, Novo Nordisk A/S published Feb. 3, 1994, describes cleaning compositions which incorporate mutant amylases. See also WO95/10603, Novo Nordisk A/S, published Apr. 20, 1995. Other amylases known for use in cleaning compositions include both (α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases arc stability-enhanced amylases described in WO94/18314, published Aug. 18, 1994 and WO96/05295, Genencor, published Feb. 22, 1996 and amylase variants having additional modification in the immediate parent available from Novo Nordisk A/S, disclosed in WO 95/10603, published April 1995. Also suitable are amylases described in EP 277 216, WO95/26397 and WO96/23873 (all by Novo Nordisk).

Examples of commercial α-amylases products are Purafect Cx Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other preferred amylolytic enzymes with improved properties with respect to the activity level and the combination of thermostability and a higher activity level are described in WO95/35382.

The amylolytic enzymes if present are generally incorporated in the detergent compositions of the present invention a level of from 0.0001% to 2%, preferably from 0.00018% to 0.06%, more preferably from 0.00024% to 0.048% pure enzyme by weight of the composition.

Suitable lipolytic enzymes for use in the present invention include those produced by micro-organisms of the Pseudomonas group, such as *Pseudomonas stutzeri* ATCC 19.154, as disclosed in British Patent 1,372,034. Suitable lipases include those which show a positive immunological cross-section with the antibody of the lipase produced by the microorganism *Pseudomonas hisorescent*. IAM 1057. This lipase is available from Amano Pharmaceutical Co. Ltd., Nagoya, Japan, under the trade name Lipase P "Amano," hereinafter referred to as "Amano-P." Other suitable commercial lipases include Amano-CES, lipases ex *Chromobacter viscosum*, e.g. *Chrormobacter viscosum* var. lipolyticum NRRLB 3673, commercially available from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as M1Lipase$^R$ and Lipomax$^R$ (Gist-Brocades) and Lipolase$^R$ and Lipolase Ultra$^R$(Novo) which have found to be very effective when used in combination with the compositions of the present invention. Also suitable are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to detergent compositions have been described in e.g. WO-A-88/09367 Genencor); WO 90/09446 (Plant Genetic System) and WO 94/14963 and WO 94/14964 (Unilever). The LIPOLASE enzyme derived from Humicola lanuginosa and commercially available from Novo (see also EPO 341,947) is a preferred lipase for use in the present invention.

Another preferred lipase for use in the present invention is D96L lipolytic enzyme variant of the native lipase derived from Humicola lanuginosa. Most preferably the Humicola lanuginosa strain DSM 4106 is used.

By D96L lipolytic enzyme variant is meant the lipase variant as described in patent application WO 92/05249 in which the native lipase ex Humicola lanuginosa has the aspartic acid (D) residue at position 96 changed to Leucine (L). According to this nomenclature said substitution of aspartic acid to Leucine in position 96 is shown as: D96L. To determine the activity of the enzyme D96L the standard LU assay may be used (Analytical method, internal Novo Nordisk number AF 95/6-GB 1991.02.07). A substrate for D96L was prepared by emulsifying glycerine tributyrate (Merck) using gum-arabic as emulsifier. Lipase activity is assayed at pH 7 using pH stat. method.

The detergent compositions of the invention may additionally incorporate one or more cellulase enzymes. Suitable cellulases include both bacterial or fungal cellulases. Preferably, they will have a pH optimum of between 5 and 12 and an activity above 50 CEVU (Cellulose Viscosity Unit). Suitable cellulases are disclosed in U.S. Pat. No. 4,435,307, Barbesgoard et al, J61078384 and WO96/02653 which disclose fungal cellulases produced respectively from *Humicola insolens*, Trichoderma, Thielavia and Sporotrichum. EP 739 982 describes cellulases isolated from novel Bacillus species. Suitable cellulases are also disclosed in GB-A-2.075.028; GB-A-2.095.275; DE-OS-2.247.832 and WO95/26398.

Examples of such cellulases are cellulases produced by a strain of *Humicola insolens* (*Humicola grisea* var. *thermoidea*), particularly the Humicola strain DSM 1800. Other suitable cellulases are cellulases originated from *Humicola insolens* having a molecular weight of about 50 KDa, an isoelectric point of 5.5 and containing 415 amino acids; and a ~43 kD endoglucanase derived from *Humicola insolens*, DSM 1800, exhibiting cellulase activity; a preferred endoglucanase component has the amino acid sequence disclosed in PCT Patent Application No. WO 91/17243. Also suitable cellulases are the EGIII cellulases from *Trichoderma longibrachiatum* described in WO94/21801, Genencor, published Sep. 29, 1994. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801. Other suitable cellulases for fabric care and/or cleaning properties are described in WO96/34092, WO96/17994 and WO95/24471.

Additional Detergent Components

The detergent compositions or components thereof in accordance with the present invention may also contain additional detergent components. The precise nature of these additional components, and levels of incorporation thereof will depend on the physical form of the composition or component thereof, and the precise nature of the washing operation for which it is to be used.

The compositions or components thereof, of the invention preferably contain one or more additional detergent components selected from additional surfactants, builders, sequestrants, bleach, bleach precursors, bleach catalysts, organic polymeric compounds, additional enzymes, suds suppressors, lime soap dispersants, additional soil suspension and anti-redeposition agents soil releasing agents, perfumes and corrosion inhibitors.

Additional Surfactant

The detergent compositions or components thereof in accordance with the invention preferably contain an additional surfactant selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

In a particularly preferred embodiment of the invention, the detergent compositions additionally comprise an anionic surfactant. Any anionic surfactant useful for detersive purposes is suitable. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other suitable anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use in the compositions of the invention include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl)glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_9$–$C_{22}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Particularly preferred compositions of the present invention additionally comprise an anionic surfactant, selected from alkyl sulfate and/or alkylbenzene sulphonate surfactants of formulae II and III, respectively:

$$R^5OSO_3^-M^+ \quad \text{(II)}$$

$$R^6SO_3^-M'^+ \quad \text{(III)}$$

wherein $R^5$ is a linear or branched alkyl or alkenyl moiety having from 9 to 22 carbon atoms, preferably $C_{12}$ to $C_{18}$ alkyl or as found in secondary alkyl sulfates; $R^6$ is $C_{10}$–$C_{16}$ alkylbenzene, preferably $C_{11}$–$C_{13}$ alkylbenzene; $M^+$ and $M'^+$ can vary independently and are selected from alkali metals, alkaline earths, alkanolammonium and ammonium.

Particularly preferred compositions of the invention comprise both an alkyl sulfate surfactant and an alkyl benzene surfactant, preferably in ratios of II to III of from 15:1 to 1:2, most preferably from 12:1 to 2:1.

Amounts of the one or mixtures of more than one anionic surfactant in the preferred composition may be from 1% to 50%, however, preferably anionic surfactant is present in amounts of from 5% to 40% by weight of the composition. Preferred amounts of the alkyl sulfate surfactant of formula II are from 3% to 40%, or more preferably 6% to 30% by weight of the detergent composition. Preferred amounts of the alkyl benzene sulphonate surfactant of formula III in the detergent composition are from at least 1%, preferably at least 2%, or even at least 4% by weight. Preferred amounts of the alkyl benzene sulphonate surfactant are up to 23%, more preferably no greater than 20%, most preferably up to 15% or even 10%.

The performance benefits which result when an anionic surfactant is also used in the compositions of the invention are particularly useful for longer carbon chain length anionic surfactants such as those having a carbon chain length of $C_{12}$ or greater, particularly of $C_{14/15}$ or even up to $C_{16\text{-}18}$ carbon chain lengths.

In preferred embodiments of the detergent compositions of the invention comprising anionic surfactant there will be a significant excess of anionic surfactants, preferably a weight ratio of anionic to cationic surfactant of from 50:1 to 2:1, most preferably 30:1 to 8:1. However, the benefits of the invention are also achieved where the ratio of cationic surfactant to anionic surfactant is substantially stoichiometric, for example from 3:2 to 4:3.

In a preferred embodiment of the invention the essential cationic surfactant of formula I is intimately mixed with one or more anionic surfactants prior to addition of the other detergent composition components.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R^1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R-CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred. Linear or branched alkoxylated groups are suitable.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula $$R^2O\ (C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(™) C2M Conc. manufactured by Miranol, Inc., Dayton, N.J.

Zwitterionic Surfactant

Zwitterionic surfactants can also be incorporated into the detergent compositions or components thereof in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane)dimethyl (or diethyl)betaines. Complex betaine surfactants are also suitable for use herein.

Additional Cationic Surfactants

The compositions of the invention are preferably substantially free of quaternary ammonium compounds of formula I but wherein one or $R^1$, $R^2$, $R^3$ or $R^4$ is an alkyl chain group longer than $C_{11}$. Preferably the composition should contain less than 1%, preferably less than 0.1% by weight or even less than 0.05% and most preferably less than 0.01% by weight of compounds of formula I having a linear (or even branched) alkyl group having 12 or more carbon atoms.

Another suitable group of cationic surfactants which can be used in the detergent compositions of the invention are cationic ester surfactants. The cationic ester surfactant is a compound having surfactant properties comprising at least one ester (i.e. —COO—) linkage and at least one cationically charged group. Preferred cationic ester surfactants are water dispersible.

Suitable cationic ester surfactants, including choline ester surfactants, have for example been disclosed in U.S. Pat. Nos. 4,228,042, 4,239,660 and 4,260,529.

In preferred cationic ester surfactants the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Alkalinity

In the detergent compositions of the present invention preferably an alkalinity system is present to achieve optimal cationic surfactant performance. The alkalinity system comprises components capable of providing alkalinity species in solution. Examples of alkalinity species include carbonate, bicarbonate, hydroxide, the various silicate anions, percarbonate, perborates, perphosphates, persulfate and persilicate. Such alkalinity species can be formed for example, when alkaline salts selected from alkali metal or alkaline earth carbonate, bicarbonate, hydroxide or silicate, including crystalline layered silicate, salts and percarbonate, perborates, perphosphates, persulfate and persilicate salts and any mixtures thereof are dissolved in water.

Examples of carbonates are the alkaline earth and alkali metal carbonates, including sodium carbonate and sesquicarbonate and any mixtures thereof with ultra-fine calcium carbonate such as are disclosed in German Patent Application No. 2,321,001 published on Nov. 15, 1973.

Suitable silicates include the water soluble sodium silicates with an $SiO_2$:$NA_2O$ ratio of from 1.0 to 2.8, with ratios of from 1.6 to 2.0 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate.

Preferred crystalline layered silicates for use herein have the general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. Herein, x in the general formula above preferably has a value of 2, 3 or 4 and is preferably 2. The most preferred material is $\delta$-$Na_2Si_2O_5$, available from Hoechst AG as NaSKS-6.

Water-Soluble Builder Compound

The detergent compositions in accordance with the present invention preferably contain a water-soluble builder compound, typically present in detergent compositions at a level of from 1% to 80% by weight, preferably from 10% to 70% by weight, most preferably from 20% to 60% by weight of the composition.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy)diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Isoluble Builder Compound

The detergent compositions or components thereof, of the present invention may contain a partially soluble or insoluble builder compound, typically present in detergent compositions at a level of from 1% to 80% by weight, preferably from 10% to 70% by weight, most preferably from 20% to 60% weight of the composition.

Examples of largely water insoluble builders include the sodium aluminosilicates.

Suitable aluminosilicate zeolites have the unit cell formula $Na_z[(AlO_2)_z(SiO_2)_y].xH_2O$ wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[(AlO_2)_{12}(SiO_2)_{12}].xH_2O$$

wherein x is from 20 to 30, especially 27. Zeolite X has the formula $$Na_{86}[(AlO_2)_{86}(SiO_2)_{106}].276H_2O.$$

Another preferred aluminosilicate zeolite is zeolite MAP builder. The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometers, more preferably from 2.0 to 7.0 micrometers, most preferably from 2.5 to 5.0 micrometers.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Heavy Metal Ion Sequestrant

The detergent compositions or components thereof in accordance with the present invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Suitable heavy metal ion sequestrants for use herein include organic phosphonates, such as the amino alkylene poly(alkylene phosphonates), alkali metal ethane 1-hydroxy disphosphonates and nitrilo trimethylene phosphonates.

Preferred among the above species are diethylene triamine penta (methylene phosphonate), ethylene diamine tri(methylene phosphonate)hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Organic Peroxyacid Bleaching System

A preferred feature of detergent compositions or component thereof in accordance with the invention is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Inorganic Perhydrate Bleaches

Inorganic perhydrate salts are a preferred source of hydrogen peroxide. These salts are normally incorporated in the form of the alkali metal, preferably sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product and/or delayed release of the perhydrate salt on contact of the granular product with water. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

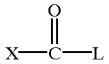

where L is a leaving group and X is essentially any functionality, such that on perhydrolysis the structure of the peroxyacid produced is

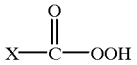

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

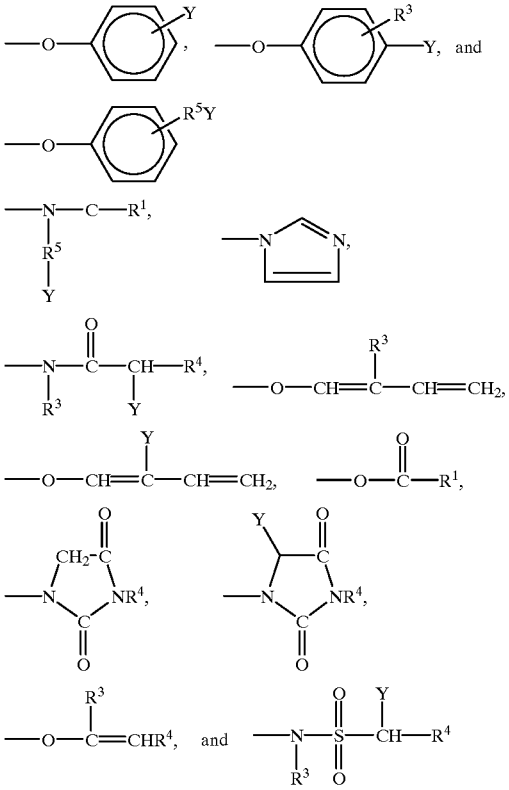

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, $R^5$ is an alkenyl chain containing from 1 to 8 carbon atoms and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<——N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1,2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable herein, including those of the following general formulae:

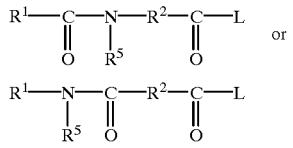

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Cationic Peroxyacid Pecursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650, 08/298904 and 08/298906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

Benzoxazin Organic Peroxyacid Precursors

Also suitable are precursor compounds of the benzoxazin-type, as disclosed for example in EP-A-332,294 and EP-A-482,807, particularly those having the formula:

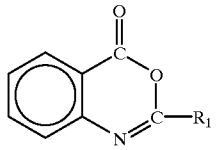

wherein $R_1$ is H, alkyl, alkaryl, aryl, or arylalkyl.

Preformed Organic Peroxyacid

The organic peroxyacid bleaching system may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

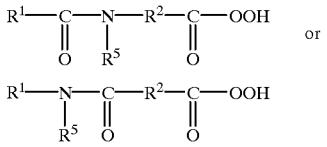

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms.

Amide substituted organic peroxyacid compounds of this type are described in EP-A-0170386.

Other organic peroxyacids include diacyl and tetraacylperoxides, especially diperoxydodecanedioc acid, diperoxytetradecanedioic acid and diperoxyhexadecanedioc acid. Mono- and diperazelaic acid, mono- and diperbrassylic acid and N-phthaloylaminoperoxicaproic acid are also suitable herein.

Bleach Catalyst

The compositions of the invention optionally contain a transition metal containing bleach catalyst. One suitable type of bleach catalyst is a catalyst system comprising a heavy metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}{}_2(u\text{-}0)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$. Still another type of bleach catalyst, as disclosed in U.S. Pat. No. 5,114,606, is a water-soluble complex of manganese (III), and/or (IV) with a ligand which is a non-carboxylate polyhydroxyl compound having at least three consecutive C—OH groups. Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$-$(ClO_4)_3$.

Further suitable bleach catalysts are described, for example, in European patent application No. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Additional Enzymes

The compositions of the present invention may comprise one or more additional enzymes.

Preferred additional enzymatic materials include the commercially available enzymes. Said enzymes include enzymes selected from hemicellulases, peroxidases, glucoamylases, xylanases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase or mixtures thereof.

A preferred combination of additional enzymes is a cleaning composition having a mixture of conventional applicable enzymes such as protease, amylase, cutinase and/or cellulase in conjunction with one or more plant cell wall degrading enzymes. Suitable enzymes are exemplified in U.S. Pat. No. 3,519,570 and 3,533,139.

Peroxidase enzymes may also be incorporated into the detergent compositions of the invention. Peroxidases are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Peroxidase-containing detergent compositions are disclosed, for example, in PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Preferred enhancers are substituted phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621) and substituted syringates (C3–C5 substituted alkyl syringates) and phenols. Sodium percarbonate or perborate are preferred sources of hydrogen peroxide.

Said peroxidases, if present, are normally incorporated in the detergent composition at levels from 0.0001% to 2% of active enzyme by weight of the detergent composition.

Said additional enzymes, when present, are normally incorporated in the detergent composition at levels from 0.0001% to 2% of active enzyme by weight of the detergent composition. The additional enzymes can be added as separate single ingredients (prills, granulates, stabilized liquids, etc. containing one enzyme) or as mixtures of two or more enzymes (e.g. cogranulates).

Enzyme Oxidation Scavengers

Other suitable detergent ingredients that can be added are enzyme oxidation scavengers which are described in Copending European Patent application 92870018.6 filed on Jan. 31, 1992. Examples of such enzyme oxidation scavengers are ethoxylated tetraethylene polyamines.

Enzyme Materials

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Organic Polymeric Compound

Organic polymeric compounds are preferred additional components of the detergent compositions or components thereof of the present invention, and are preferably present as components of any particulate component of the detergent composition where they may act such as to bind the particulate component together. By organic polymeric compound is meant any polymeric organic compound commonly used as dispersants, anti-redeposition or soil suspension agents in detergent compositions, including any of the high molecular weight organic polymeric compounds described as clay flocculating agents herein.

Such an organic polymeric compound is generally incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylic acid or polyacrylates of MWt 1000–5000 and their copolymers with maleic anhydride, such copolymers having a molecular weight of from 2000 to 100,000, especially 40,000 to 80,000. Polymaleates or polymaleic acid polymers and salts thereof are also suitable examples.

Polyamino compounds useful herein include those derived from aspartic acid including polyaspartic acid and such as those disclosed in EP-A-305282, EP-A-305283 and EP-A-351629.

Terpolymers containing monomer units selected from maleic acid, acrylic acid, aspartic acid and vinyl alcohol or acetate, particularly those having an average molecular weight of from 1,000 to 30,000, preferably 3,000 to 10,000, are also suitable for incorporation into the compositions of the present invention.

Other organic polymeric compounds suitable for incorporation in the detergent compositions of the present invention include cellulose derivatives such as methylcellulose, carboxymethylcellulose, hydroxypropylmethylcellulose, ethylhydroxyethylcellulose and hydroxycthylcellulose.

Further useful organic polymeric compounds are the polyethylene glycols, particularly those of molecular weight 1000 to 10000, more particularly 2000 to 8000 and most preferably about 4000.

Cationic Soil Removal/Anti-Redeposition Compounds

The detergent composition or components thereof of the invention may comprise water-soluble cationic ethoxylated amine compounds with particulate soil/clay-soil removal and/or anti-redeposition properties. These cationic compounds are described in more detail in EP-B-111965, U.S. Pat. No. 4,659,802 and U.S. Pat. No. 4,664,848. Particularly preferred of these cationic compounds are ethoxylated cationic monoamines, diamines or triamines. Especially preferred are the ethoxylated cationic monoamines, diamines and triamines of the formula:

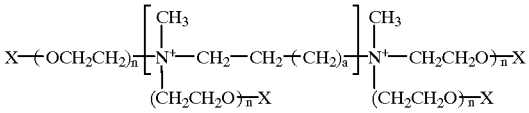

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 2, 1 or 0; for cationic monoamines (b=0), n is preferably at least 16, with a typical range of from 20 to 35; for cationic diamines or triamines, n is preferably at least about 12 with a typical range of from about 12 to about 42.

These compounds where present in the composition, are generally present in an amount of from 0.01 to 30% by weight, preferably 0.05 to 10% by weight.

Suds Suppressing System

The detergent compositions of the invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostcaryl di-alkali metal (e.g. sodium, potassium, lithium) phosphates and phosphate esters.

A preferred suds suppressing system comprises (a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Polymeric Dye Transfer Inhibiting Agents

The detergent compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidone polymers or combinations thereof, whereby these polymers can be cross-linked polymers.

a) Polyamine N-oxide Polymers

Polyamine N-oxide polymers suitable for use herein contain units having the following structure formula:

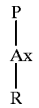

(I)

wherein P is a polymerisable unit, and

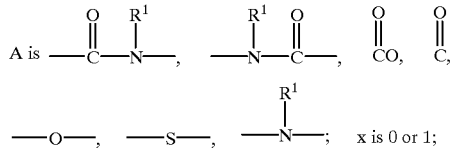

$R^1$ is H or $C_{1-6}$ linear or branched alkyl; or may form a heterocyclic group with R; R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

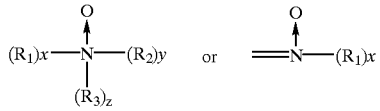

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups. The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyridine, N-substituted pyrrole, imidazole, N-substituted pyrrolidine, piperidine, quinoline, acridine and derivatives thereof.

Other suitable polyamine N-oxides are the polyamine oxides whereto the N—O group is attached to the polymerisable unit. A preferred class of these polyamine N-oxides comprises the polyamine N-oxides having the general formula (I) wherein R is an aromatic,heterocyclic or alicyclic groups wherein the nitrogen of the N—O functional group is part of said R group. Examples of these classes are polyamine oxides wherein R is a heterocyclic compound such as pyridine, N-substituted pyrrole, imidazole and derivatives thereof.

The polyamine N-oxides can be obtained in almost any degree of polymerisation. The degree of polymerisation is not critical provided the material has the desired water-solubility and dye-suspending power. Typically, the average molecular weight is within the range of 500 to 1000,000.

b) Copolymers of N-vinylpyrrolidone and N-vinylimidazole

Suitable herein are copolymers of N-vinylimidazole and N-vinylpyrrolidone having a preferred average molecular weight range of from 5,000 to 100,000, or 5,000 to 50,000. The preferred copolymers have a molar ratio of N-vinylimidazole to N-vinylpyrrolidone from 1 to 0.2.

c) Polyvinylpyrrolidone

The detergent compositions herein may also utilize polyvinylpyrrolidone ("PVP") having an average molecular weight of from 2,500 to 400,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Corporation include Sokalan HP 165 and Sokalan HP 12.

d) Polyvinyloxazolidone

The detergent compositions herein may also utilize polyvinyloxazolidones as polymeric dye transfer inhibiting agents. Said polyvinyloxazolidones have an average molecular weight of from 2,500 to 400,000.

e) Polyvinylimidazole

The detergent compositions herein may also utilize polyvinylimidazole as polymeric dye transfer inhibiting agent. Said polyvinylimidazoles preferably have an average molecular weight of from 2,500 to 400,000.

Optical Brightener

The detergent compositions herein also optionally contain from about 0.005% to 5% by weight of certain types of hydrophilic optical brighteners.

Hydrophilic optical brighteners useful herein include those having the structural formula:

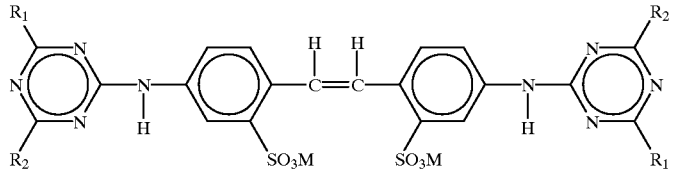

wherein $R^1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2', -stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Polymeric Soil Release Agent

Known polymeric soil release agents, hereinafter "SRA", can optionally be employed in the present detergent compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric or polymeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SMIOO and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urcthane-linked variety, see U.S. Pat. No. 4,201,824, Violland et al.;

Other Optional Ingredients

Other optional ingredients suitable for inclusion in the compositions of the invention include perfumes, colours and filler salts, with sodium sulfate being a preferred filler salt.

Near Neutral Wash pH Detergent Formulation

While the detergent compositions of the present invention are operative within a wide range of wash pHs (e.g. from about 5 to about 12), they are particularly suitable when formulated to provide a near neutral wash pH, i.e. an initial pH of from about 7.0 to about 10.5 at a concentration of from about 0.1 to about 2% by weight in water at 20° C. Near neutral wash pH formulations are better for enzyme stability and for preventing stains from setting. In such formulations, the wash pH is preferably from about 7.0 to about 10.5, more preferably from about 8.0 to about 10.5, most preferably from 8.0 to 9.0.

Preferred near neutral wash pH detergent formulations are disclosed to European Patent Application 83.200688.6, filed May 16, 1983, J. H. M. Wertz and P. C. E. Goffinet.

Highly preferred compositions of this type also preferably contain from about 2 to about 10% by weight of citric acid and minor amounts (e.g., less than about 20% by weight) of neutralizing agents, buffering agents, phase regulants, hydrotropes, enzymes, enzyme stabilizing agents, polyacids, suds regulants, opacifiers, antioxidants, bactericides, dyes, perfumes and brighteners, such as those described in U.S. Pat. No. 4,285,841 to Barrat et al., issued Aug. 25, 1981 (herein incorporated by reference).

Form of the Compositions

The compositions in accordance with the invention can take a variety of physical forms including granular, tablet, flake, pastille and bar and liquid forms. Liquids may be aqueous or non-aqueous and may be in the form of a gel. The compositions are particularly the so-called concentrated granular detergent compositions adapted to be added to a washing machine by means of a dispensing device placed in the machine drum with the soiled fabric load.

Such granular detergent compositions or components thereof in accordance with the present invention can be made via a variety of methods, including spray-drying, dry-mixing, extrusion, agglomerating and granulation. The cationic quaternised surfactant can be added to the other detergent components by mixing, agglomeration (preferably combined with a carrier material), granulation or as a spray-dried component.

The compositions in accordance with the present invention can also be used in or in combination with bleach additive compositions, for example comprising chlorine bleach.

In one aspect of the invention the mean particle size of the components of granular compositions in accordance with the invention, should preferably be such that no more than 15% of the particles are greater than 1.8 mm in diameter and not more than 15% of the particles are less than 0.25 mm in diameter. Preferably the mean particle size is such that from 10% to 50% of the particles has a particle size of from 0.2 mm to 0.7 mm in diameter.

The term mean particle size as defined herein is calculated by sieving a sample of the composition into a number of fractions (typically 5 fractions) on a series of sieves, preferably Tyler sieves. The weight fractions thereby obtained are plotted against the aperture size of the sieves. The mean particle size is taken to be the aperture size through which 50% by weight of the sample would pass.

In a further aspect of the invention at least 80%, preferably at least 90% by weight of the composition comprises particles of mean particle size at least 0.8 mm, more preferably at least 1.0 mm and most preferably from 1.0, or 1.5 to 2.5 mm. Most preferably at least 95% of the particles will have such a mean particle size. Such particles are preferably prepared by an extrusion process. Preferably the cationic surfactant and detersive enzyme are contained in the same particle.

The bulk density of granular detergent compositions in accordance with the present invention typically have a bulk density of at least 400, preferably at least 600 g/liter, more preferably from 650 g/liter to 1200 g/liter. Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement eg; a knife, across its upper edge. The filled cup is then weighed and the value obtained for the weight of powder doubled to provide a bulk density in g/liter. Replicate measurements are made as required.

Compacted solids may be manufactured using any suitable compacting process, such as tabletting, briquetting or extrusion, preferably tabletting. Preferably tablets for use in dish washing processes, are manufactured using a standard rotary tabletting press using compression forces of from 5 to 13 $KN/cm^2$, more preferably from 5 to 11 $KN/cm^2$ so that the compacted solid has a minimum hardness of 176N to 275N, prcferably from 195N to 245N, measured by a C100 hardness test as supplied by I. Holland instruments. This process may be used to prepare homogeneous or layered tablets of any size or shape. Preferably tablets are symmetrical to ensure the uniform dissolution of the tablet in the wash solution.

Laundry Washing Method

Machinc laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods. Dosage is dependent upon the particular conditions such as water hardness and degree of soiling of the soiled laundry.

The detergent composition may be dispensed for example, from the drawer dispenser of a washing machine or may be sprinkled over the soiled laundry placed in the machine.

In one use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

The dispensing device containing the detergent product is placed inside the drum before the commencement of the wash, before, simultaneously with or after the washing machine has been loaded with laundry. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of product in the drum of the washing machine at this stage of the wash cycle.

Preferred dispensing devices are reusable and are designed in such a way that container integrity is maintained in both the dry state and during the wash cycle.

Especially preferred dispensing devices for use with the composition of the invention have been described in the following patents; GB-B-2, 157, 717, GB-B-2, 157, 718, EP-A-0201376, EP-A-0288345 and EP-A-0288346. An article by J. Bland published in Manufacturing Chemist, November 1989, pages 41–46 also describes especially preferred dispensing devices for use with granular laundry products which are of a type commonly know as the "granulette". Another preferred dispensing device for use with the compositions of this invention is disclosed in PCT Patent Application No. WO94/11562.

Especially preferred dispensing devices are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

Machine Dishwashing Method

Any suitable methods for machine dishwashing or cleaning soiled tableware, particularly soiled silverware are envisaged.

A preferred machine dishwashing method comprises treating soiled articles selected from crockery, glassware, hollowware, silverware and cutlery and mixtures thereof, with an aqueous liquid having dissolved or dispensed therein an effective amount of a machine dishwashing composition in accord with the invention. By an effective amount of the machine dishwashing composition it is meant from 8 g to 60 g of product dissolved or dispersed in a wash solution of volume from 3 to 10 liters, as are typical product dosages and wash solution volumes commonly employed in conventional machine dishwashing methods.

Packaging for the Compositions

Commercially marketed executions of the bleaching compositions can be packaged in any suitable container including those constructed from paper, cardboard, plastic materials and any suitable laminates. A preferred packaging execution is described in European Application No. 94921505.7.

Abbreviations Used in Examples

In the detergent compositions, the abbreviated component identifications have the following meanings:

| | |
|---|---|
| LAS | Sodium linear $C_{12}$ alkyl benzene sulfonate |
| TAS | Sodium tallow alkyl sulfate |
| CxyAS | Sodium $C_{1x}$–$C_{1y}$ alkyl sulfate |
| C46SAS | Sodium $C_{14}$–$C_{16}$ secondary (2, 3) alkyl sulfate |
| CxyEzS | Sodium $C_{1x}$—$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS 1 | $R_2.N^+(CH_3)_2(C_2H_4OH)$ with $R_2 = C_9$—$C_{11}$ linear alkyl |
| QAS 2 | $R_2.N^+(CH_3)_2(C_2H_4OH)$ with approximately 50% $R_2 = C_8$ linear alkyl; approximately 50% $R_2 = C_{10}$ |
| QAS 3 | $R_2.N^+(CH_3)_2(C_2H_4OH)$ with approximately 40% $R_2 = C_{11}$ linear alkyl; approximately 60% $R_2 = C_9$ linear alkyl |
| QAS 4 | $R_2.N^+(CH_3)_2(C_2H_4OH)$ with $R_2 = C_6$ linear alkyl |
| QAS 5 | $R_2.N^+(CH_3)_2(C_2H_4OH)$ with $R_2 = C_{10}$ linear alkyl |
| Soap | Sodium linear alkyl carboxylate derived from an 80/20 mixture of tallow and coconut oils |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{12}$–$C_{14}$ topped whole cut fatty acids |
| STPP | Anhydrous sodium tripolyphosphate |
| TSPP | Tetrasodium pyrophosphate |
| Zeolite A | Hydrated Sodium Aluminosilicate of formula $Na_{12}(A10_2SiO_2)_{12}.27\ H_2O$ having a primary particle size in the range from 0.1 to 10 micrometers |
| Zeolite MAP | Hydrated sodium aluminosilicate zeolite MAP having a silicon to aluminium ratio of 1.07 |
| NaSKS-6 | Crystalline layered silicate of formula δ-$Na_2Si_2O_5$ |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous Sodium Silicate ($SiO_2$:$Na_2O$ = 2.0:1) |
| Sodium sulfate | Anhydrous sodium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme of activity 4 KNPU/g sold by NOVO Industries A/S under the tradename Savinase |
| Alcalase | Proteolytic enzyme of activity 3 AU/g sold by NOVO Industries A/S |
| Cellulase | Cellulytic enzyme of activity 1000 CEVU/g sold by NOVO Industries A/S under the tradename Carezyme |
| Amylase | Amylolytic enzyme of activity 120 KNU/g sold by NOVO Industries A/S under the tradename Termamyl 120 T |
| Lipase | Lipolytic enzyme of activity 100 KLU/g sold by NOVO Industries A/S under the tradename Lipolase |
| Endolase | Endoglucanase enzyme of activity 3000 CEVU/g sold by NOVO Industries A/S |
| PB4 | Sodium perborate tetrahydrate of nominal formula $NaBO_2.3\ H_2O.H_2O_2$ |
| PB1 | Anhydrous sodium perborate bleach of nominal formula $NaBO_2.H_2O_2$ |
| Percarbonate | Sodium percarbonate of nominal formula $2\ Na_2CO_3.3\ H_2O_2$ |
| NOBS | Nonanoyloxybenzene sulfonate in the form of the sodium salt |
| TAED | Tetraacetytethylenediamine |

-continued

| | |
|---|---|
| Mn catalyst | $Mn^{IV}{}_2$(m-O)$_3$1,4,7-trimethyl-1,4,7-triazacyclononane)$_2$($PF_6$)$_2$, as described in U. S. Pat. Nos. 5,246,621 and 5,244,594. |
| DTPA | Diethylene triamine pentaacetic acid |
| DTPMP | Diethylene triamine penta(methylene phosphonate), marketed by Monsanto under the Tradename Dequest 2060 |
| Photoactivated bleach | Sulfonated Zinc Phthlocyanine encapsulated in bleach dextrin soluble polymer |
| Brightener 1 | Disodium 4,4'-bis(2-sulphostyry)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| EDDS | Ethylenediamine-N,N-disuccinic acid |
| QEA | bis(($C_2H_5O$)($C_2H_4O_n$)($CH_3$)-$N^+$-$C_6H_{12}$-$N^+$-($CH_3$)bis(($C_2H_5O$)-($C_2H_4O$)$_n$), wherein n = from 20 to 30 |
| PEGX | Polyethylene glycol, with a molecular weight of x |
| PEO | Polyethylene oxide, with a molecular weight of 50,000 |
| TEPAE | Tetraethylenepentaamine ethoxylate |
| PVP | Polyvinylpyrolidone polymer |
| PVNO | Polyvinylpyridine N-oxide |
| PVPVI | Copolymer of polyvinylpyrolidone and vinylimidazole |
| SRP 1 | Sulfobenzoyl and capped esters with oxyethylene oxy and terephtaloyl backbone |
| SRP 2 | Diethoxylated poly(1,2 propylene terephtalate) short block polymer |
| Silicone antifoam | Polydimethylsiloxane foam controller with siloxane-oxyalkylene copolymer as dispersing agent with a ratio of said foam controller to said dispersing agent of 10:1 to 100:1 |
| Wax | Paraffin wax |

EXAMPLE 1

The following high density granular laundry detergent compositions A to F of particular utility under European machine wash conditions are examples of the present invention:

| | A | B | C | D | E | F |
|---|---|---|---|---|---|---|
| LAS | 8.0 | 8.0 | 8.0 | 8.0 | 8.0 | 8.0 |
| C25E3 | 3.4 | 3.4 | 3.4 | 3.4 | 3.4 | 3.4 |
| C46AS | 1.0 | 2.0 | 2.5 | — | 3.0 | 4.0 |
| C68AS | 3.0 | 2.0 | 5.0 | 7.0 | 1.0 | 0.5 |
| QAS 1 | 0.05 | — | — | — | — | 0.8 |
| QAS 2 | — | 0.05 | 0.8 | — | — | — |
| QAS 3 | — | — | — | 1.4 | 1.0 | |
| Zeolite A | 18.1 | 18.1 | 16.1 | 18.1 | 18.1 | 18.1 |
| Zeolite MAP | — | 4.0 | 3.5 | — | — | — |
| Carbonate | 12.0 | 12.0 | 13.0 | 26.0 | 26.0 | 26.0 |
| Silicate | 1.4 | 1.4 | 1.4 | 3.0 | 3.0 | 3.0 |
| NaSKS-6 (citric acid 79:21) | 11.0 | 6.0 | 6.0 | — | — | 12.5 |
| Sodium Sulfate | 26.1 | 26.1 | 25.0 | 17.1 | 24.1 | 9.1 |
| MA/AA | 0.3 | 0.3 | 0.3 | 0.3 | 0.3 | 0.3 |
| CMC | 0.2 | 0.2 | 0.2 | 0.2 | 0.2 | 0.2 |
| PB4 | 9.0 | 9.0 | 9.0 | 9.0 | 9.0 | 9.0 |
| TAED | 1.5 | 1.5. | 1.0 | 1.5 | — | 1.5 |
| Mn Catalyst | — | 0.03 | 0.07 | — | — | — |
| DTPMP | 0.25 | 0.25 | — | 0.25 | 0.25 | 0.25 |
| HEDP | 0.3 | 0.3 | 0.2 | 0.2 | 0.3 | 0.3 |
| EDDS | — | — | 0.4 | 0.2 | — | — |
| QEA | 1.0 | 0.8 | 0.7 | 1.2 | — | 0.5 |
| Protease | 0.85 | 0.85 | 0.26 | 0.85 | 0.85 | 0.85 |
| Amylase | 0.1 | 0.1 | 0.4 | 0.3 | 0.1 | 0.1 |
| Lipase | 0.05 | 0.6 | 0.7 | 0.1 | 0.07 | 0.1 |

-continued

| | A | B | C | D | E | F |
|---|---|---|---|---|---|---|
| Photoactivated bleach (ppm) | 15 ppm | 15 ppm | 15 ppm | 15 ppm | 15 ppm | 15 ppm |
| Brightener 1 | 0.09 | 0.09 | — | 0.09 | 0.09 | 0.09 |
| Perfume | 0.3 | 0.3 | 0.3 | 0.3 | 0.3 | 0.3 |
| Silicone antifoam | 0.5 | 0.5 | 0.5 | 0.5 | 0.5 | 0.5 |
| Misc/minors to 100% | | | | | | |
| Density in g/liter | 850 | 850 | 850 | 850 | 850 | 850 |

EXAMPLE 2

The following granular laundry detergent compositions G to I of particular utility under European machine wash conditions are examples of the present invention:

| | G | H | I |
|---|---|---|---|
| LAS | 5.3 | 5.6 | 4.8 |
| TAS | 1.3 | 1.9 | 1.6 |
| C45AS | — | 2.2 | 3.9 |
| C25E3S | — | 0.8 | 1.2 |
| C45E7 | 3.3 | — | 5.0 |
| C25E3 | — | 5.5 | — |
| QAS 1 | 0.8 | 3.0 | 2.5 |
| STPP | 19.7 | — | — |
| Zeolite A | — | 19.5 | 19.5 |
| Zeolite MAP | 2.0 | — | — |
| NaSKS-6/citric acid(79:21) | — | 13.0 | 10.6 |
| Carbonate | 5.1 | 18.4 | 21.4 |
| Bicarbonate | — | 2.0 | 2.0 |
| Silicate | 6.8 | — | — |
| Sodium Sulfate | 37.8 | — | 7.0 |
| MA/AA | 0.8 | 1.6 | 1.6 |
| CMC | 0.2 | 0.4 | 0.4 |
| PB4 | 5.0 | 12.7 | — |
| Percarbonate | 5.0 | — | 12.7 |
| TAED | 0.5 | 3.1 | — |
| Mn Catalyst | 0.04 | — | — |
| DTPMP | 0.25 | 0.2 | 0.2 |
| HEDP | — | 0.3 | 0.3 |
| QEA | 0.9 | — | — |
| Protease | 0.85 | 2.8 | 0.85 |
| Lipase | 0.15 | 0.25 | 0.15 |
| Cellulase | 0.2 | 0.3 | 0.3 |
| Amylase | 0.4 | 0.1 | 0.1 |
| PVP | 0.9 | 1.3 | 0.8 |
| Photoactivated bleach (ppm) | 15 ppm | 27 ppm | 27 ppm |
| Brightener 1 | 0.08 | 0.19 | 0.19 |
| Brightener 2 | — | 0.04 | 0.04 |
| Perfume | 0.3 | 0.3 | 0.3 |
| Silicone antifoam | 0.5 | 2.4 | 2.4 |
| Minors/misc to 100% | | | |

EXAMPLE 3

The following detergent formulations of particular utility under European machine wash conditions are examples of the present invention.

| | J | K | L | M |
|---|---|---|---|---|
| Blown powder | | | | |
| LAS | 6.0 | 5.0 | 11.0 | 6.0 |
| TAS | 2.0 | — | — | 2.0 |

-continued

| | J | K | L | M |
|---|---|---|---|---|
| QAS 2 | 0.8 | 1.0 | — | — |
| QAS 3 | — | — | 1.5 | 0.6 |
| Zeolite A | — | 27.0 | — | 20.0 |
| STPP | 24.0 | — | 24.0 | — |
| Sulfate | 6.0 | 6.0 | 9.0 | — |
| MA/AA | 2.0 | 4.0 | 6.0 | 4.0 |
| Silicate | 7.0 | 3.0 | 3.0 | 3.0 |
| CMC | 1.0 | 1.0 | 0.5 | 0.6 |
| QEA | — | — | 1.4 | 0.5 |
| Brightener | 0.2 | 0.2 | 0.2 | 0.2 |
| Silicone antifoam | 1.0 | 1.0 | 1.0 | 0.3 |
| DTPMP | 0.4 | 0.4 | 0.2 | 0.4 |
| Spray on | | | | |
| C45E7 | — | — | — | 5.0 |
| C45E5 | 2.5 | 2.5 | 2.0 | — |
| C45E3 | 2.6 | 2.5 | 2.0 | — |
| Perfume | 0.3 | 0.3 | 0.3 | 0.2 |
| Silicone antifoam | 0.3 | 0.3 | 0.3 | — |
| Dry additives | | | | |
| Sulfate | 3.0 | 3.0 | 5.0 | 10.0 |
| Carbonate | 6.0 | 13.0 | 15.0 | 14.0 |
| PB1 | — | — | — | 1.5 |
| PB4 | 18.0 | 18.0 | 10.0 | 18.5 |
| TAED | 3.0 | 2.0 | — | 2.0 |
| EDDS | — | 2.0 | 2.4 | — |
| Protease | 3.25 | 1.0 | 3.25 | 3.25 |
| Lipase | 0.4 | 0.5 | 0.4 | 0.2 |
| Amylase | 0.2 | 0.3 | 0.2 | 0.4 |
| Photoactivated bleach | — | — | — | 0.15 |
| Minors/misc to 100% | | | | |

EXAMPLE 4

The following granular detergent formulations arc examples of the present invention. Formulation N is particularly suitable for usage under Japanese machine wash conditions. Formulations O to S are particularly suitable for use under US machine wash conditions.

| | N | O | P | Q | R | S |
|---|---|---|---|---|---|---|
| Blown powder | | | | | | |
| LAS | 22.0 | 5.0 | 4.0 | 9.0 | 8.0 | 7.0 |
| C45AS | 7.0 | 7.0 | 6.0 | — | — | — |
| C46AS | — | 4.0 | 3.0 | — | — | — |
| C45E35 | — | 3.0 | 2.0 | 8.0 | 5.0 | 4.0 |
| QAS 1 | 0.5 | — | — | — | — | — |
| QAS 2 | — | 0.5 | — | 2.0 | — | 3.5 |
| QAS 3 | — | — | 0.8 | — | 3.0 | — |
| Zeolite A | 6.0 | 16.0 | 14.0 | 19.0 | 16.0 | 14.0 |
| MA/AA | 6.0 | 3.0 | 3.0 | — | — | — |
| AA | — | 3.0 | 3.0 | 2.0 | 3.0 | 3.0 |
| Sodium Sulfate | 6.0 | 3.3 | 2.3 | 24.0 | 13.3 | 193 |
| Silicate | 5.0 | 1.0 | 1.0 | 2.0 | 1.0 | 1.0 |
| Carbonate | 24.3 | 9.0 | 3.0 | 25.7 | 8.0 | 6.0 |
| QEA | 0.4 | 0.4 | — | — | 0.5 | 1.1 |
| PEG 4000 | 0.5 | — | 1.5 | 1.0 | 1.5 | 1.0 |
| Sodium oleate | 2.0 | — | — | — | — | — |
| DTPA | 0.4 | — | 0.5 | — | — | 0.5 |
| Brightener | 0.2 | 0.3 | 0.3 | 0.3 | 0.3 | 0.3 |
| Spray on | | | | | | |
| C25E5 | 1.0 | — | — | — | — | — |
| C45E7 | — | 2.0 | 2.0 | 0.5 | 2.0 | 2.0 |
| Perfume | 1.0 | 0.3 | 0.3 | 1.0 | 0.3 | 0.3 |
| Agglomerates | | | | | | |
| C45AS | — | 5.0 | 5.0 | — | 5.0 | 5.0 |
| LAS | — | 2.0 | 2.0 | — | 2.0 | 2.0 |

-continued

| | N | O | P | Q | R | S |
|---|---|---|---|---|---|---|
| Zeolite A | — | 7.5 | 7.5 | — | 7.5 | 7.5 |
| HEDP | — | 1.0 | — | — | 2.0 | — |
| Carbonate | — | 4.0 | 4.0 | — | 4.0 | 4.0 |
| PEG 4000 | — | 0.5 | 0.5 | — | 0.5 | 0.5 |
| Misc(water etc) | — | 2.0 | 2.0 | — | 2.0 | 2.0 |
| Dry additives | | | | | | |
| TAED | 1.0 | 2.0 | 3.0 | 1.0 | 3.0 | 2.0 |
| PB4 | — | 1.0 | 4.0 | — | 5.0 | 0.5 |
| PB1 | 6.0 | — | — | — | — | — |
| Percarbonate | — | 5.0 | 12.5 | — | — | — |
| Carbonate | — | 5.3 | 1.8 | — | 4.0 | 4.0 |
| NOBS | 4.5 | — | 6.0 | — | — | 0.6 |
| Cumeme sulfonic acid | — | 2.0 | 2.0 | — | 2.0 | 2.0 |
| Lipase | — | 0.4 | 0.4 | — | 0.05 | 0.2 |
| Cellulase | — | 0.2 | 0.2 | — | 0.2 | 0.2 |
| Amylase | — | 0.3 | 0.3 | — | — | — |
| Protease | 5.3 | 1.6 | 1.6 | 0.3 | 1.6 | 1.6 |
| PVPVI | — | 0.5 | — | — | — | — |
| PVP | 0.5 | — | — | — | — | — |
| PVNO | — | 0.5 | 0.5 | — | — | — |
| SRP1 | — | 0.5 | 0.5 | — | — | — |
| Silicone antifoam | — | 0.2 | 0.2 | — | 0.2 | 0.2 |
| Minors/misc to 100% | | | | | | |

EXAMPLE 5

The following granular detergent formulations are examples of the present invention. Formulations W and X are of particular utility under US machine wash conditions. Y is of particular utility under Japanese machine wash conditions.

| | T | U | V |
|---|---|---|---|
| Blown Powder | | | |
| Zeolite A | 30.0 | 22.0 | 6.0 |
| Sodium Sulfate | 19.0 | 5.0 | 7.0 |
| MA/AA | 3.0 | 2.0 | 6.0 |
| LAS | 14.0 | 12.0 | 22.0 |
| C45AS | 8.0 | 7.0 | 7.0 |
| QAS 1 | 0.7 | — | — |
| QAS 2 | — | 2.2 | — |
| QAS 5 | — | — | 1.5 |
| Silicate | — | 1.0 | 5.0 |
| Soap | — | — | 2.0 |
| Brightener 1 | 0.2 | 0.2 | 0.2 |
| Carbonate | 7.0 | 16.0 | 20.0 |
| DTPMP | — | 0.4 | 0.4 |
| Spray On | — | 1.0 | 5.0 |
| C45E7 | 1.0 | 1.0 | 1.0 |
| Dry additives | | | |
| HEDP | 1.0 | — | — |
| PVPVI/PVNO | 0.5 | 0.5 | 0.5 |
| Protease | 3.3 | 3.3 | 3.3 |
| Lipase | 0.4 | 0.1 | 0.2 |
| Amylase | 0.1 | 0.1 | 0.1 |
| Cellulase | 0.1 | 0.1 | 0.1 |
| TAED | — | 6.1 | 4.5 |
| PB1 | 11.0 | 5.0 | 6.0 |
| Sodium Sulfate | — | 6.0 | — |
| Balance (Moisture and Misc.) | | | |

EXAMPLE 6

The following granular detergent compositions of particular utility under European wash conditions were are examples of the present invention.

| | W | X |
|---|---|---|
| Blown powder | | |
| Zeolite A | 20.0 | — |
| STPP | — | 20.0 |
| LAS | 6.0 | 6.0 |
| C68AS | 2.0 | 2.0 |
| QAS 1 | 0.01 | — |
| QAS 4 | — | 0.6 |
| Silicate | 3.0 | 8.0 |
| MA/AA | 4.0 | 2.0 |
| CMC | 0.6 | 0.6 |
| Brightener 1 | 0.2 | 0.2 |
| DTPMP | 0.4 | 0.4 |
| Spray on | | |
| C45E7 | 5.0 | 5.0 |
| Silicone antifoam | 0.3 | 0.3 |
| Perfume | 0.2 | 0.2 |
| Dry additives | | |
| Carbonate | 14.0 | 9.0 |
| PB1 | 1.5 | 2.0 |
| PB4 | 18.5 | 13.0 |
| TAED | 2.0 | 2.0 |
| Photoactivated bleach | 15 ppm | 15 ppm |
| Protease | 1.0 | 1.0 |
| Lipase | 0.2 | 0.08 |
| Amylase | 0.4 | 0.4 |
| Cellulase | 0.1 | 0.1 |
| Sulfate | 10.0 | 20.0 |
| Balance (Moisture and Misc.) | 10.6 | 5.12 |
| Density (g/liter) | 700 | 700 |

EXAMPLE 7

The following detergent compositions are examples of the present invention:

| | Y | Z | AA |
|---|---|---|---|
| Blown Powder | | | |
| Zeolite A | 15.0 | 15.0 | 15.0 |
| Sodium Sulfate | 0.0 | 0.0 | 0.0 |
| LAS | 3.0 | 3.0 | 3.0 |
| QAS 2 | 1.0 | — | — |
| QAS 5 | — | 3.0 | 2.0 |
| DTPMP | 0.4 | 0.2 | 0.4 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 1.0 |
| Silicate | 3.0 | 3.0 | 4.0 |
| QEA | — | 1.0 | 0.6 |
| Mn Catalyst | 0.03 | — | — |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry additives | | | |
| Citrate | 5.0 | — | 2.0 |
| Bicarbonate | — | 3.0 | — |
| Carbonate | 8.0 | 15.0 | 8.0 |
| Percarbonate | — | 7.0 | 10.0 |
| TAED | 6.0 | 2.0 | 5.0 |
| PB1 | 14.0 | 7.0 | 8.0 |
| EDDS | — | 2.0 | — |

-continued

| | Y | Z | AA |
|---|---|---|---|
| Polyethylene oxide of MW 5,000,000 | — | — | 0.2 |
| Bentonite clay | — | — | 10.0 |
| Protease | 1.0 | 3.3 | 3.3 |
| Lipase | 0.4 | 0.1 | 1.0 |
| Amylase | 0.6 | 0.6 | — |
| Cellulase | 0.6 | 0.6 | — |
| Silicone antifoam | 5.0 | 5.0 | 5.0 |
| Dry additives | | | |
| Sodium sulfate | 0.0 | 3.0 | 0.0 |
| Balance (Moisture and Misc.) to 100% | 5.3 | 0.8 | 0.1 |
| Density (g/liter) | 850 | 850 | 850 |

EXAMPLE 8

The following detergent formulations are examples of the present invention:

| | BB | CC | DD | EE |
|---|---|---|---|---|
| LAS | 20.0 | 14.0 | 24.0 | 22.0 |
| QAS 1 | 0.7 | 1.0 | 0 | 0 |
| QAS 2 | — | — | 0.08 | — |
| QAS 4 | — | — | — | 1.0 |
| TFAA | — | 1.0 | — | — |
| C25E5/C45E7 | — | 2.0 | — | 0.5 |
| C45E3S | — | 2.5 | — | — |
| STPP | 30.0 | 18.0 | 30.0 | 22.0 |
| Silicate | 9.0 | 5.0 | 10.0 | 8.0 |
| Carbonate | 13.0 | 7.5 | — | 5.0 |
| Bicarbonate | — | 7.5 | — | — |
| Percarbonate | — | 5.0 | 9.0 | 15.0 |
| DTPMP | 0.7 | 1.0 | — | — |
| QEA 1 | 0.4 | 1.2 | 0.5 | 2.0 |
| QEA 2 | 0.4 | — | — | — |
| SRP 1 | 0.3 | 0.2 | — | 0.1 |
| MA/AA | 2.0 | 1.5 | 2.0 | 1.0 |
| CMC | 0.8 | 0.4 | 0.4 | 0.2 |
| Protease | 2.6 | 3.3 | 1.6 | 1.6 |
| Amylase | 0.8 | 0.4 | — | — |
| Lipase | 0.2 | 0.06 | 0.25 | 0.1 |
| Cellulase | 0.15 | 0.05 | — | — |
| Photoactivated bleach (ppm) | 70 ppm | 45 ppm | — | 10 ppm |
| Brightener 1 | 0.2 | 0.2 | 0.08 | 0.2 |
| PB1 | 6.0 | 2.0 | — | — |
| HEDP | — | — | 2.3 | — |
| TAED | 2.0 | 1.0 | — | — |
| Balance (Moisture and Misc.) to 100% | | | | |

EXAMPLE 9

The following laundry bar detergent compositions are examples of the present invention.

| | FF | GG | HH | II | JJ | KK | LL | MM |
|---|---|---|---|---|---|---|---|---|
| LAS | — | — | 19.0 | 15.0 | 21.0 | 6.75 | 8.8 | — |
| C28AS | 30.0 | 13.5 | — | — | — | 15.75 | 11.2 | 22.5 |
| Sodium laurate | 2.5 | 9.0 | — | — | — | — | — | — |
| QAS 1 | — | — | — | 0.08 | — | — | 2.0 | — |
| QAS 2 | 1.5 | — | 0.8 | — | — | — | — | — |
| QAS 3 | — | 5 | — | — | — | — | — | 0.1 |

-continued

| | FF | GG | HH | II | JJ | KK | LL | MM |
|---|---|---|---|---|---|---|---|---|
| QAS 4 | — | — | — | — | 1.5 | 0.04 | — | — |
| QAS 5 | — | — | — | — | — | 0.04 | — | — |
| Zeolite A | 2.0 | 1.25 | — | — | — | 1.25 | 1.25 | 1.25 |
| Carbonate | 20.0 | 3.0 | 13.0 | 8.0 | 10.0 | 15.0 | 15.0 | 10.0 |
| Calcium carbonate | 21.5 | — | — | — | — | — | — | — |
| Sulfate | 5.0 | — | — | — | — | — | — | — |
| TSPP | 5.0 | — | 5.0 | — | 5.0 | 5.0 | 2.5 | 5.0 |
| STPP | 5.0 | 15.0 | — | — | — | 5.0 | 8.0 | 10.0 |
| Bentonite clay | — | 10.0 | — | — | 5.0 | — | — | — |
| DTPMP | — | 0.7 | 0.6 | — | 0.6 | 0.7 | 0.7 | 0.7 |
| MA/AA | 0.4 | 1.0 | — | — | 0.2 | 0.4 | 0.5 | 0.4 |
| SPP1 | 0.3 | 0.3 | 0.3 | 0.3 | 0.3 | 0.3 | 0.3 | 0.3 |
| Protease | 0.2 | 0.4 | 0.4 | 0.3 | 0.3 | 1.5 | 0.3 | 0.3 |
| Lipase | — | 0.1 | — | — | 0.2 | — | — | — |
| Amylase | — | — | — | — | — | — | 0.1 | — |
| Cellulase | — | 0.15 | — | — | 0.15 | — | — | — |
| PEO | — | 0.2 | — | 0.2 | 0.3 | — | — | 0.3 |
| Perfume | 1.6 | — | — | — | — | — | — | — |

What is claimed is:

1. A detergent composition comprising:

(a) from 0.25% to 3%, by weight of composition of a mixture of cationic surfactants of the formula:

$$R^1R^2R^3R^4N^+X^- \quad (I)$$

wherein $R^1$ is an optionally substituted phenol or hydroxyalkyl group having no greater than 6 carbon atoms; each of $R^2$ and $R^3$ is independently selected from $C_{1-4}$ alkyl or alkenyl; $R^4$ is a $C_8$–$C_{11}$ alkyl or alkenyl; and X is a counter ion and wherein said mixture comprises a cationic surfactant with $R^4$ having n carbon atoms where n is 8 to 11 and a cationic surfactant wherein $R^4$ is alkyl with (n−2) carbon atoms;

(b) from 1% to 50% by weight of composition of at least one anionic surfactant which is alkyl benzene sulfonate;

(c) optionally, from 0.5% to 20%, by weight of composition of at least one nonionic surfactant; and (d) detersive enzyme;

wherein the weight ratio of said detersive enzyme to said cationic surfactant is from 1:10000 to 5:1.

2. A detergent composition according to claim 1 further comprising from 0.01% to 10%, by weight of composition of polymeric dye transfer inhibiting agent.

3. A detergent composition according to claim 1 wherein said composition comprises a nonionic surfactant selected from the group consisting of alkylalkoxylates, polyhydroxy fatty acid amides, fatty acid amides, alcohol ethoxylates, alkyl phenol ethoxylates, alkylpolysaccharides, and mixtures thereof.

4. A detergent composition according to claim 1 wherein said anionic surfactant comprises a mixture of:

(i) from 3% to about 40%, by weight of the composition, of at least one alkyl sulfate surfactant of the formula $R^5OSO_3M$; and (ii) from 6% to about 23%, by weight of the composition, of an alkyl benzene sulfonate of the formula $R^6SO_3M$;

wherein $R^5$ is $C_{9-22}$ alkyl; $R^6$ is $C_{10-20}$ alkyl benzene; and M is alkali metals, alkaline earth metals, alkanolammonium, ammonium and mixtures thereof.

5. A detergent composition according to claim 1 wherein said composition comprises more than one of said cationic surfactants and wherein further at least 10% of said cationic surfactants have $R^4$ which is $C_{5-9}$ alkyl or alkenyl.

6. A detergent composition according to claim 1 wherein R1 is selected from the group consisting of —$CH_2CH_2OH$, —$CH_2CH_2CH_2OH$, —$CH_2CH(CH_3)OH$, and $CH(CH_3)CH_2OH$.

7. A detergent composition according to claim 1 wherein said composition further comprises one or more selected from the group consisting of organic polymeric compounds, suds suppressors, lime soap dispersants, soil releasing agents, corrosion inhibitors and mixtures thereof.

8. A detergent composition according to claim 1 wherein said composition further comprises a bleach.

9. A detergent composition according to claim 1 in the form or a gel, bar or tablet.

10. A detergent composition according to claim 1 wherein said detersive enzyme is selected from the group consisting of proteolytic enzyme; cellulytic enzyme; amylolytic enzyme; a lipolytic enzyme; and mixtures thereof.

* * * * *